United States Patent [19]

Nitz

[11] Patent Number: 4,487,543

[45] Date of Patent: Dec. 11, 1984

[54] GARBAGE TRUCK WITH REVOLVING RECEPTACLE

[75] Inventor: Martin Nitz, Wesel, Fed. Rep. of Germany

[73] Assignee: Gabler GmbH & Co. KG, Wesel, Fed. Rep. of Germany

[21] Appl. No.: 372,961

[22] Filed: Apr. 29, 1982

[51] Int. Cl.[3] ..... B65F 3/22

[52] U.S. Cl. ..... 414/468; 366/60

[58] Field of Search ..... 414/468; 366/60

[56] References Cited

U.S. PATENT DOCUMENTS 3,627,281 12/1971 Peterson ..... 366/60

*Primary Examiner*—Robert G. Sheridan

*Attorney, Agent, or Firm*—Parmelee, Bollinger & Barmblett

[57] ABSTRACT

A control system is provided for a garbage truck with a revolving receptacle having an adjusting pump which is remotely controlled by a control card having special control characteristics for the hydraulic system.

3 Claims, 1 Drawing Figure

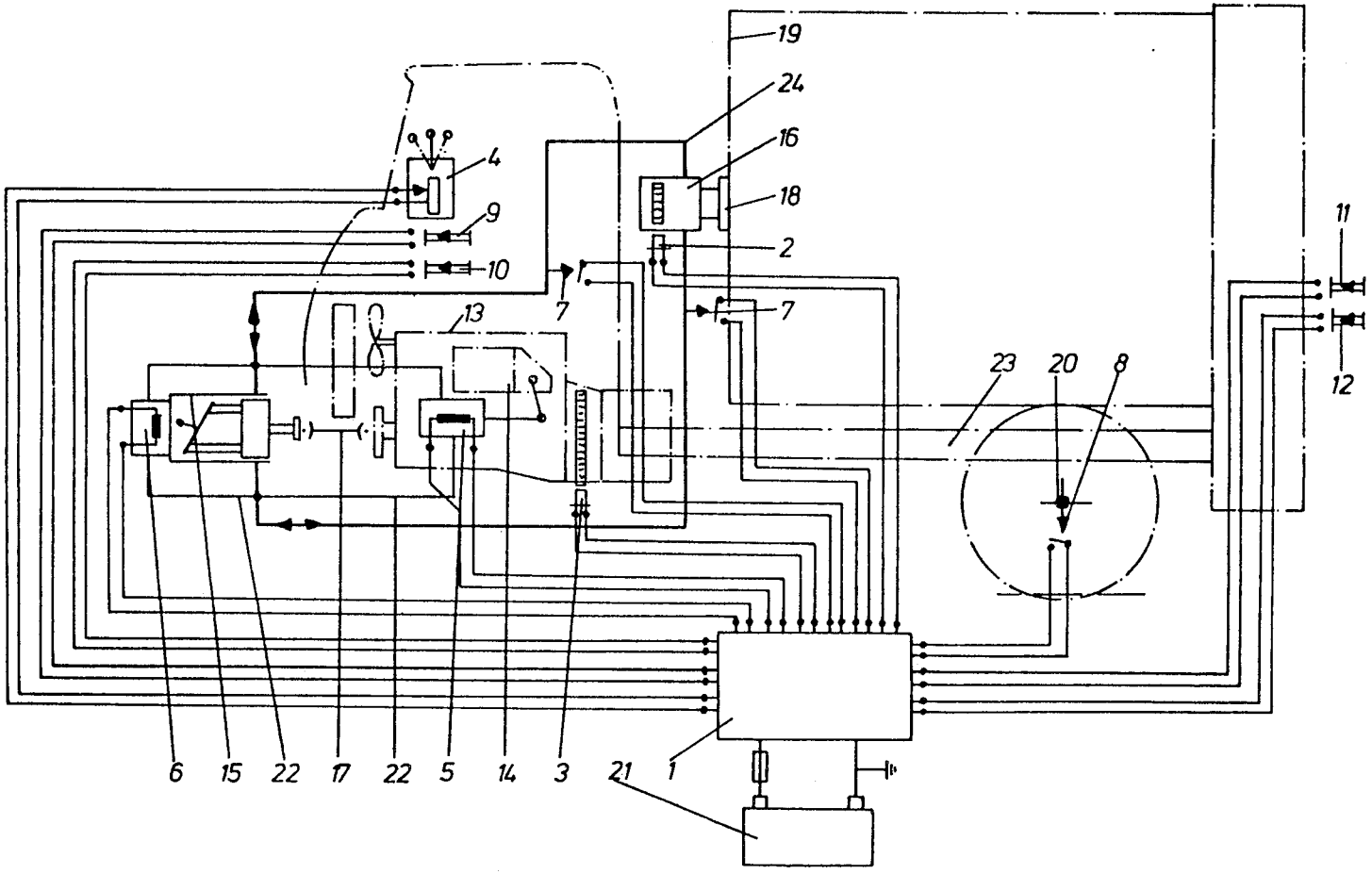
11
12
8
20
23
19
24
16
18
2
7
1
21
3
14
5
22
17
22
15
6
4
9
10
13

GARBAGE TRUCK WITH REVOLVING RECEPTACLE

BACKGROUND OF THE INVENTION

The invention relates to a garbage truck with revolving receptacle according to West German patent application No. P 31 13 819.5, in which the transmission gear has a hydrostatic drive with constant quantity control.

According to the parent patent, an adjusting pump of a larger size corresponding with the quantity being conveyed is installed for the drive, said pump being controlled by different transmitters and supplying at different rates of driving revolutions always the amount of fluid required for the operating rate of revolutions of the receptacle. With such constant control of the quantity, the rate of revolutions of the driving motor is adjusted simultaneously with the adjustment of the adjusting pump either by way of the desired rate of revolutions of the receptacle (speed control) or by way of the pressure (load control).

When the receptacle is without load, i.e., when loading is started, an increased idle time of the motor suffices to overcome the internal friction. As the load increases, the motor accelerates in order to attain its power or torque required for the respective load.

In practical applications, it was found that it is useful in accordance with the invention to provide an electro-hydraulic linear drive as the servo adjusting device for the driving Diesel engine, and an electro-hydraulic servo device for the adjusting pump, said servo devices being controlled by a vehicle-controlling card.

According to a refinement of the invention, the revolving receptacle is driven by way of a gearing actuated by a constant motor, said gearing being controllable by an inductive transmitter for the rate of revolutions, said transmitter being influenced by the controlling card.

Furthermore, it is useful to interconnect in the control circuit a rear-axle overload circuit breaker as the pulse transmitter for the payload.

In order to permit a trouble-free control and to achieve a low response-delay moment, a closed hydraulic circuit is provided between the constant motor and the adjusting pump.

The arrangement according to the invention permits achieving a fuel saving of at least 25%, which offers the additional advantage of achieving less gaseous emissions due to the lower load of the motor, and also of reducing the development of noise, which is advantageously noticeable when collecting refuse in health resorts or purely residential areas.

An embodiment of the invention is shown in the drawing and described in the following in greater detail.

The inductive transmitter 2 is used as the pulse transmitter for supplying the rate of revolutions of the receptacle 19 to a vehicle controller i.e., the vehicle control card 1. Control card 1, with pre-selection, also actuates the inductive transmitter 3 for receiving the rate of revolutions of driving Diesel engine 13 as well as control signals from the remote control unit 4.

The electro-hydraulic linear servo 5 serving as the servo device for Diesel engine 13 and the electro-hydraulic servo controller 6 for the adjusting pump 15 are arranged in a closed hydraulic circuit system 24, in which there is arranged also the pressure switch 7 for both directions of rotation. On the rear axle, overload breaker 8 serves as the pulse transmitter for the payload received. The operation can be controlled by way of ON/OFF press key 9 and receptacle return press key 10, as well as receptacle ON/OFF key 11 and EMERGENCY OFF key 12. As mentioned earlier, the injection pump 14 of the Diesel engine is controlled by the electro-hydraulic linear servo drive 5.

The adjusting pump 15 is acting on the constant motor 16, whereas the drive 17 is acting on the adjusting pump 15.

The driving transmission 18 with the constant motor is flanged on the revolving receptacle 19.

The rear axle 20 of the chassis effects the actuation of the rear-axle overload breaker 8. The power is supplied by a battery 21. The electro-hydraulic servo controlling unit 6 is connected with the pressure switch 7 by way of pressure fluid line 22.

The operator's cabin is outlined and the chassis 23 with the revolving receptacle 19 and refuse is shown by dash-dotted lines.

The mode of operation of the equipment is described as follows:

(a) The inductive transmitter (pulse transmitter) 2 for the rate of revolutions signals and controls the rate of revolutions of receptacle 19 by way of controlling card 1. If the rate of revolutions drops (due to increased power consumption), the required power is "additionally" supplied by way of Diesel engine 13, or the total system is shut down in the event of a sudden drop in the rate of revolutions (clogging).

(b) The inductive transmitter (pulse transmitter) 3 for the rate of revolutions signals and controls the rate of revolutions of Diesel engine 13 by way of controlling card 1. If the rate of revolutions decreases (due to increased power consumption), the rate of revolutions of motor 13 is maintained constant, or the rate of revolutions is reduced in the event of excess revolutions ("racing" of the motor, for example when reaching the load limit).

(c) The remote control unit 4 permits a preselection of the required function by way of controlling card 1. The modes of operation, once set, are always maintained even if other controls are manipulated: clockwise or anticlockwise rotation of the receptacle, or driving operation (standstill of the receptacle) (+, 0, −).

(d) The electro-hydraulic servo drive is a power drive acted upon by its own (existing) hydraulic system (by way of hydraulic fluid lines 22), said drive receiving its commands from controlling card 1 and performing mechanical work, in the present case, adjustment of injection pump 14 of Diesel engine 13 to the desired rate of revolutions (nonvibrating).

(e) The electro-hydraulic servo drive 6 is a power drive acted upon by its own (existing) hydraulic system (by way of hydraulic fluid lines 22), said drive being controlled by controlling card 1 and controlling the delivery of adjusting pump 15.

(f) The pressure switches 7 of both acted-upon lines (both directions of rotation) of the closed hydraulic circuit system 24 permit an additional control of the total system by way of controlling card 1, namely depending on the power.

(g) The rear-axle overload breaker (pulse transmitter) 8, which is adjustable according to the spring characteristic, shuts down the total system with delayed vibration when the permissible payload is reached.

(h) For short-time operations (driving the vehicle from one pile of refuse cans to the next), the system is switched on and off by means of ON/OFF key 9, for the mode of operation preselected by way of remote control unit 4.

(i) The receptacle return key 10 permits by way of controlling card 1 an intentionally limited return rotation (against the loading direction) of the receptacle 19 in order to "return" bulky pieces of refuse that causes a shutdown ("clogging") of the system (compare function "a") (any "return" is hazardous).

(j) The ON/OFF key 11, which is arranged at a different point, has the same function as key 9, also by way of controlling card 1.

(k) In emergency/accident situations, the total system is shut off instantaneously by means of emergency OFF key 12 by way of controlling card 1. Said key 12 may only be used for shutting the system OFF.

(l) The vehicle-controlling card 1 and thus the entire system is supplied with power by battery 21 (in practical applications ±2.9 volts at 0.14 watt).

In summary, it must be stated that the system according to the invention permits a remote control comprising a number of command posts. With the safety circuit, all consumers of hydraulic power are set to the zero position in case of power failure or if power supply lines are damaged mechanically. According to the invention, the vehicle controlling card 1 is particularly adapted to saving fuel while a garbage truck with revolving receptacle is being loaded, said controlling card being adapted to special control characteristics for the hydraulic system, permitting a simple control of many hydraulic units of a garbage truck in the form of a single-lever control. Furthermore, the control card with the design according to the invention, in combination with the device as defined by the invention, represents the link between rough electric switching elements, mechanical components and electronics. Finally, in practical applications, the device is accident-proof, because the operating personnel must not perform monitoring functions. The controlling card can be manufactured and exchanged in a simple fashion.

I claim:

1. A diesel engine garbage truck having a revolving receptacle with a hydrostatic drive, said hydrostatic drive having an adjusting pump driven by a diesel engine, an electro-hydraulic linear servo drive coupled to said diesel engine for controlling said diesel engine, an electro-hydraulic servo controller coupled to said adjusting pump, a control circuit coupled to said servo drive and said servo controller, a closed hydraulic circuit coupling said adjusting pump to said hydrostatic drive for said receptacle, and transmitter means coupled between said hydrostatic drive and said diesel engine for providing said control circuit with revolution rates of said drive and said diesel engine for controlling the operation of said garbage truck.

2. The garbage truck as claimed in claim 1, in which said revolving receptacle is driven by a constant motor through a transmission means, said transmitter means comprising an inductive transmitter which monitors the revolutions of said motor and supplies the rate of revolutions of said motor to said control circuit.

3. The garbage truck as claimed in claim 1 or 2 having a rear axle overload breaker connected to said control circuit for providing a signal to said control circuit when the permissible payload in the receptacle is reached.

* * * * *